United States Patent [19]

Hadfield

[11] 3,998,164

[45] Dec. 21, 1976

[54] SELF-DESTRUCT DELAY FUZE

[75] Inventor: Harry J. Hadfield, Califon, N.J.

[73] Assignee: The United States of America as represented by the Secretary of the Army, Washington, D.C.

[22] Filed: Dec. 15, 1975

[21] Appl. No.: 640,615

[52] U.S. Cl. ..... 102/81.2; 102/76 P; 102/83; 102/86; 102/71

[51] Int. Cl.[2] ..... F42C 15/04

[58] Field of Search ..... 102/81, 83, 86, 81.2, 102/78, 79, 76 P, 71

[56] References Cited

UNITED STATES PATENTS

| | | | |
|---|---|---|---|
| 1,857,131 | 5/1932 | Barker | 102/86 |
| 2,748,708 | 6/1956 | Bertram | 102/81.2 X |
| 2,856,854 | 10/1958 | Bowersett et al. | 102/81.2 X |
| 2,925,778 | 2/1960 | VonNemeth | 102/78 |
| 3,712,421 | 1/1973 | Hadfield | 185/37 |
| 3,768,407 | 10/1973 | Savarese | 102/83 X |
| 3,913,483 | 10/1975 | Wolterman | 102/81 X |
| 3,919,941 | 11/1975 | Breed et al. | 102/78 |

*Primary Examiner*—David H. Brown
*Attorney, Agent, or Firm*—Nathan Edelberg; A. Victor Erkkila; Thomas R. Webb

[57] ABSTRACT

A conventional impact-sensitive fuze for an explosive projectile, comprising a support frame having a transverse channel, containing an arming slider having a locking hole and a detonator, and an axial opening in which a firing pin is slidably mounted by means of a slidable weight in which the firing pin is threaded, is modified by substituting, for the firing pin, a tubular firing pin support containing a timing member having a shaft and a head or paddle forming part of a retarding dashpot, and a spring-loaded firing pin connected to the timing member shaft by a camming pin and helical slot connection. In safe condition, the firing pin is in forward position engaging the locking hole in the slider. When the firing pin support and firing pin are retracted, the slider moves into armed position, and the timing member starts to rotate, retarded by the dashpot. If the fuze has not functioned normally, the timing member rotates sufficiently, after a predetermined time, to release the pin from the slot and self-destruct the fuze.

7 Claims, 4 Drawing Figures

SELF-DESTRUCT DELAY FUZE

GOVERNMENTAL INTEREST

The invention described herein may be manufactured, used and licensed by or for the Government for governmental purposes without the payment to me of any royalty thereon.

BACKGROUND AND SUMMARY OF THE INVENTION

The present invention relates to an improved time-controlled fuze, and particularly a time-controlled means for causing an explosive device, such as an explosive projectile or grenade, to self-destruct after a predetermined time, in the event that it has not been exploded by that time by actuation of its normal fuze, as by impact or proximity with a target.

The present invention involves the combination of the rotary timer of my U.S. Pat. No. 3,712,421, dated Jan. 23, 1973, with other elements to produce an improved time-controlled self-destruct fuze, and the combination of such fuze with an impact-actuated fuze.

DETAILED DESCRIPTION OF A PREFERRED EMBODIMENT

Figure 1:
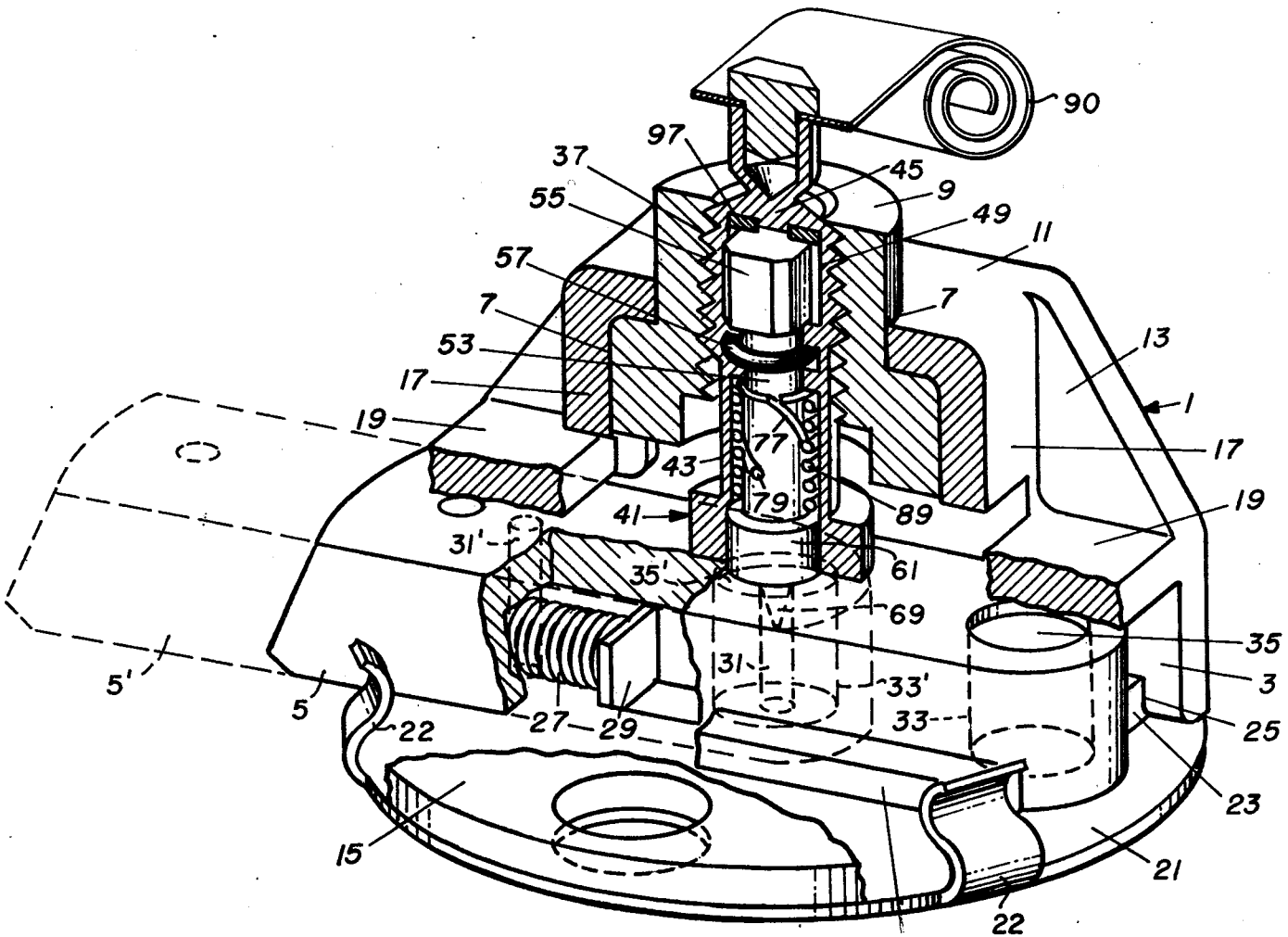
FIG. 1 is a perspective view, partially cut-away, of a projectile fuze incorporating the present invention.

FIG. 1 shows an example wherein the self-destruct firing pin assembly is substituted bodily for the conventional one-piece firing pin in the existing M223 fuze, which is used for impact initiation of the M42 submunitions. The fuze comprises a support frame 1 having a transverse slider channel 3 at its base for a detonator support or slider 5, and a circular opening 7 at its top, normal to the channel 3, for slidably holding an annular weight 9. The frame 1 is made from a stamped flat blank comprising a top section 11 containing opening 7, two wide side sections 13 (one shown) having end flanges 15 (one shown) forming the base of the frame, and two narrow side sections 17 having end flanges 19 sandwiched between the side sections 13.

The slider 5 is held in channel 3 by a circular cover plate 21 having resilient clips 22 which engage the flanges 15. The slider 5, which has two side flanges 23 slidable in grooves 25 (one shown) in the inner surfaces of the frame sides 13, is resiliently urged in one direction, to the left in FIG. 1, by a coil spring 27 engaging a flange 29 on cover plate 15. Slider 5 is formed with a locking opening 31 near its center, and a detonator opening 33 near its right end, in which a detonator 35 is mounted.

The firing weight 9, which has a tight frictional fit in frame opening 7, is axially threaded at 37, to receive external threads 39 on a firing pin support 41, which has the same external shape and size as the firing pin of the M223 fuze referred to above. As shown best in FIG. 2, the firing pin support 41 comprises a generally tubular section 43, closed at one end by a plug 45, and open at the other end. A short intermediate portion 47 of the tubular section 43 is reduced in internal diameter to define a dashpot chamber 49 between the portion 47 and the plug 45. A rotary timing member 51 has a cylindrical shaft 53 rotatably mounted in intermediate portion 47 and an enlarged head or paddle 55 disposed in chamber 49. An O-ring 57 between shaft 53 and section 47 provides a fluid seal for the chamber. The timer head 55 is preferably non-circular in cross section, as shown in FIG. 3, with a predetermined clearance between the head and the chamber wall. The space within the chamber between the timing member 51 and the firing pin support 41 is completely filled with a highly-viscous liquid 59, such as viscous silicone-gum, to retard the rotary motion of the timing member therein, as in my U.S. Pat. No. 3,712,421, referred to above.

Figure 2:
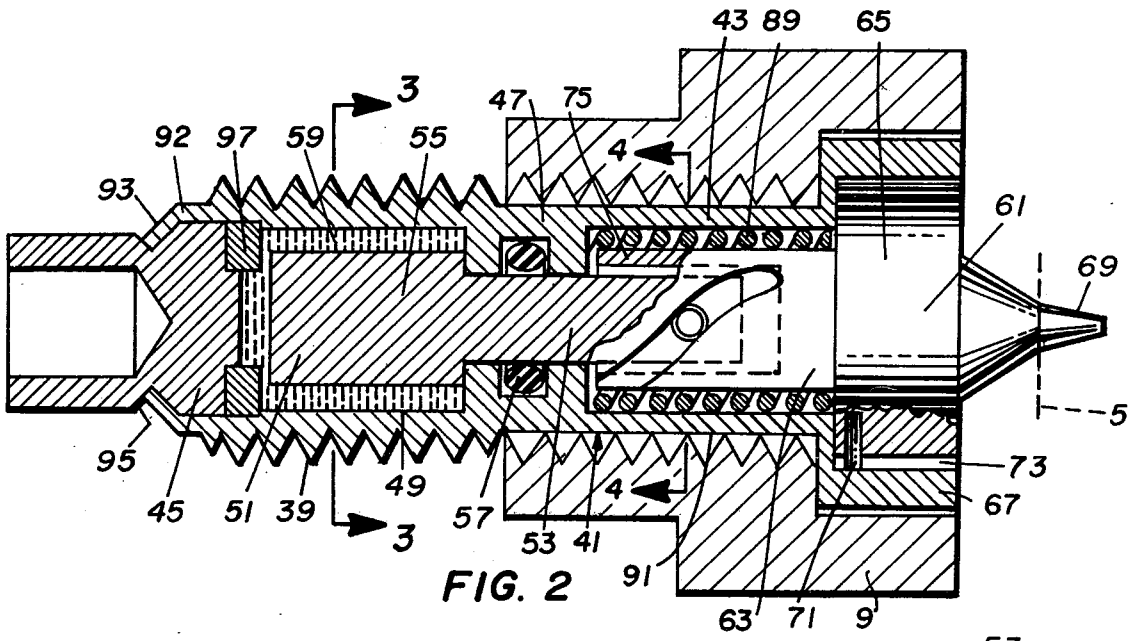
FIG. 2 is an axial section view of the firing pin assembly and weight of the fuze of FIG. 1.
Figure 4:
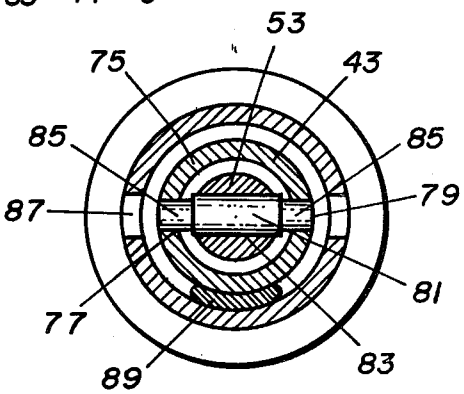
FIG. 4 is a transverse section view taken on line 4-4 of FIG. 2.
Figure 3:
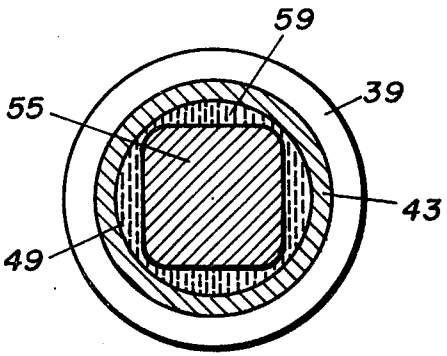
FIG. 3 is a transverse section view taken on line 3-3 of FIG. 2.

As shown in FIG. 2, the shaft 53 of the timing member 51 extends an appreciable distance beyond the intermediate portion 47 to cooperate with a firing pin 61 disposed in the open end of the support 41. The firing pin 61 comprises a cup-shaped portion 63 disposed in spaced relation within the tubular section 43 and telescoped over the shaft 53, an enlarged head portion 65 slidable in an enlarged portion 67 of tubular section 43, and a firing point 69. Rotation of the firing pin 61 in section 43 is prevented by a guide pin 71 in head portion 65 riding in a longitudinal groove 73 in enlarged portion 67. The tubular side wall 75 of firing pin portion 63 is mechanically coupled to the timing member 51 by means of two opposed helical slots 77, 180° apart in side wall 75, and a transverse, floating, camming pin 79 which extends through the shaft 53 and the slots 77. Preferably, the pin 79 comprises an enlarged intermediate portion 81 which fits within a transverse opening 83 in the shaft, and smaller diameter end portions 85 which fit within the slots 77 (see FIG. 4). The slots 77 open through the open end of portion 63. Openings 87 are provided in portion 43 to permit insertion of the camming pin 79 into the opening 81. The slider 5, spring 27 and detonator 34 constitute a detonator assembly 36 mounted adjacent to the open end of support 41. The firing pin is resiliently urged toward the slider 5 (to the right in FIG. 2) by a coil spring 89 surrounding the cup-shaped portion 63 and extending between portion 47 and head portion 65.

FIGS. 1 and 2 show the parts in SAFE position, in solid lines, with the weight 9 up and the firing pin 61 held up against spring 89 by engagement of the firing point 69 in slider opening 31, thus locking the slider 5 in SAFE position with the detonator 35 out of line with the firing point 69. In normal use, the fuze is mounted on an explosive projectile (not shown) adapted to travel toward a target in the downward direction in FIG. 1. During the flight of the projectile before striking the target, a suitably-shaped tail member 90, such as the ribbon 38 in Wolterman Pat. No. 3,913,483, dated Oct. 21, 1975, attached to and trailing behind the plug 45, interacts with the airstream to rotate the threaded support 41 in the threaded weight 9, thereby retracting the support and firing pin upwardly in FIG. 1, and withdrawing the firing point 69 from the slider opening 31. FIG. 2 shows the firing pin support 41 retracted in the weight 9. The support 41 has a relieved area 91, between the threads 39 and the enlarged portion 67, which is longer than the length of the threads 37 in the weight to permit free-spinning of the support 41 in the weight after complete retraction of the support. When released, the slider 5 is moved by spring 27 to the dashed position 5' shown in FIG. 1, to align the detonator 35 with the firing pin 61, thus arming the fuze. When the projectile strikes the target, the weight 9 moves downward, by inertia, carrying with it the retracted firing pin 61 and causing the firing point to initiate the detonator 35, which in turn, initiates the main explosive charge of the projectile.

As soon as the support 41 and firing pin 61 are retracted, the spring 89 starts a forward motion of the firing pin in the support, and the pin-and-slot connection starts a rotation of the timing member 51, retarded by the dashpot action of the head 55 in the chamber 49. In the event of a misfire on impact with the target, the rotation of the timing member 51 eventually allows the camming pin 79 to emerge from the slots 77, which releases the firing pin 61 to initiate the detonator and self-destruct the projectile. The time required for this to happen is predetermined by the dashpot geometry and the viscosity and pressure of the liquid 59.

Prior to assembly of the parts, the plug end 92 of tubular section 43 is straight walled, and the assembly is as follows: First, the O-ring 57 and then the timing member 51 are inserted into section 43. The timing member is rotated to align the shaft opening 83 with the access holes 87, and the camming pin 79 is inserted in opening 83. A predetermined quantity of liquid 59 is dispensed into chamber 49, the plug 45 is inserted, and an end portion 93 of the tubular section 43 is crimped or swaged into a groove 95 in the plug. Preferably, the chamber volume and liquid pressure are adjusted by inserting a spacer ring 97 of predetermined thickness between plug 45 and timer head 55. Next, the spring 89 and firing pin 61 are inserted into the section 43, with the helical slots 77 receiving the camming pin 79 and the guide pin 71 entering groove 73. Then, with the cover plate 21 and slider 5 removed, the firing pin support 41 is mounted in the weight 9, the slider is placed in channel 3 with the firing point 69 in locking opening 31, and the cover plate 21 is assembled to the frame flanges 15. Further conventional safety features, such as setback actuated or spin-released locks, may be provided in the fuze, if desired, for redundancy.

The foregoing disclosure and drawings are merely illustrative of the principles of this invention and are not to be interpreted in a limiting sense. I wish it to be understood that I do not desire to be limited to the exact details of construction shown and described, because obvious modifications will occur to a person skilled in the art.

What is claimed is:

1. A self-destruct delay fuze comprising:

a generally tubular firing pin support open at one end and closed at the other end;

a detonator assembly, comprising a detonator, mounted adjacent to said open end of said support;

a firing pin slidably mounted in said open end of said support for firing said detonator, said firing pin having a firing point at one end and a tubular portion a the other end formed with at least one helical slot;

spring means urging said firing pin toward said detonator assembly;

means for preventing rotary movement of said firing pin in said support;

a timing member comprising a cylindrical shaft telescoped within said tubular firing pin portion and a paddle rotatably mounted within the closed end of said support;

a camming pin disposed transversely in said shaft of said timing member and extending through said helical slot, for converting the sliding motion of said firing pin to rotary motion of said timing member;

means for limiting longitudinal movement of said timing member in said support; and a ring seal disposed between sid shaft and said support adjacent to said paddle, to form a fluid-tight chamber between said paddle and said support;

said chamber being filled with a highly viscous fluid, to retard the rotary motion of said paddle in said support.

2. A fuze as in claim 1, wherein said means for limiting longitudinal movement of said timing member includes an annular spacer of predetermined volume interposed between the rear end of said paddle and the closed end of said support and maintaining said fluid under a predetermined pressure.

3. A fuze as in claim 2, wherein said tubula firing pin support is closed by a plug inserted a predetermined distance into said support and rigidly attached thereto.

4. A fuze as in claim 1, further comprising a support frame in which said firing pin support is movable toward and away from said detonator assembly, and means for moving said firing pin support a predetermined distance from said detonator assembly, to start the self-destruct delay cycle.

5. A fuze as in claim 4, wherein said firing pin support is carried by an annular weight frictionally slidable in said frame toward said detonator upon impact of said fuze by a target in a direction opposite to the firing movement of said firing pin, after said movement of said support but prior to the self-destruct operation of said spring means, to fire said detonator.

6. A fuze as in claim 4, wherein said detonator assembly further comprises means for moving sad detonator in said frame transverse to the direction of movement of said firing pin support, from a safe position wherein it is out of the path of said firing point, to an armed position wherein it is aligned with said firing point.

7. A fuze as in claim 6, wherein said detonator is carried by a slider having a locking recess aligned with said firing point in said safe position, to receive said firing point and lock said slider in said safe position prior to said movement of said firing pin support.

* * * * *